US005785290A

United States Patent [19]

Harris

[11] Patent Number: 5,785,290

[45] Date of Patent: Jul. 28, 1998

[54] BEVERAGE HOLDER ATTACHABLE TO THE LEG OF A TABLE HAVING Z-SHAPED PARALLEL PLATFORMS

[76] Inventor: Ernestine Harris, 5640 Golf Pointe Dr., #104, Sarasota, Fla. 34243

[21] Appl. No.: 538,003

[22] Filed: Oct. 2, 1995

[51] Int. Cl.[6] ..... A47K 1/09

[52] U.S. Cl. ..... 248/311.2; 248/315; 248/174; 248/230.7; 248/205.2; 108/25; 108/152; 108/92; 108/42

[58] Field of Search ..... 248/311.2, 315, 248/300, 230.1, 230.7, 312, 210, 238, 152, 205.2, 174; 211/88, 90.01, 90.04, 130.1, 72, 73, 153; 108/25, 26, 152, 92, 49, 42; D7/602, 701, 620, 553; D27/126

[56] References Cited

U.S. PATENT DOCUMENTS

| | | | |
|---|---|---|---|
| D. 248,909 | 8/1978 | Frazian . | |
| D. 257,113 | 9/1980 | McCaffrey | D7/620 X |
| D. 341,521 | 11/1993 | Norbury et al. | D7/553 X |
| 442,468 | 12/1890 | Wegener | 108/152 X |
| 1,012,959 | 12/1911 | Zaharis | 108/92 |
| 1,911,959 | 5/1933 | Kern et al. | 248/300 |
| 1,937,994 | 12/1933 | Taylor | 211/88 X |
| 1,994,200 | 3/1935 | Parker | 211/88 |
| 2,107,381 | 2/1938 | Leppke | 211/71 |
| 3,259,082 | 7/1966 | Williams | 108/92 |
| 3,338,628 | 8/1967 | Evans | 211/72 X |
| 4,836,403 | 6/1989 | Blackman | 211/88 X |
| 4,893,773 | 1/1990 | Fujimoto | 248/300 X |
| 4,953,716 | 9/1990 | Rapoport | 108/152 X |
| 5,042,770 | 8/1991 | Louthan | D7/620 X |
| 5,070,795 | 12/1991 | Redlin et al. | 108/25 X |
| 5,078,056 | 1/1992 | McCauley . | |
| 5,085,389 | 2/1992 | Levesque | 248/300 |
| 5,085,391 | 2/1992 | Berger et al. | 248/311.2 |
| 5,140,914 | 8/1992 | Bohbot et al. | 108/152 X |
| 5,143,337 | 9/1992 | Tomayko, Jr. et al. | 248/311.2 |
| 5,169,108 | 12/1992 | Carlson | 248/315 X |

*Primary Examiner*—Ramon O. Ramirez
*Assistant Examiner*—Stephen S. Wentsler
*Attorney, Agent, or Firm*—Stein, Schifino & Van Der Wall

[57] ABSTRACT

A multi-platformed apparatus, which can be attached to a leg of a table to serve as a holding device for containers of individual portions of food and drink. The apparatus is constructed of rigid material reshaped into a vertical spine (16) and, as extensions of the spine (6), two horizontal platforms: the beverage deck (12) comprising a hole (8) for cup holding and a plate deck for plate holding, (24). The plate deck (14) is recessed under the beverage deck (12) as the result of the formation of a 45 degree angle at the beverage deck border (20—20) and another 45 degree angle at a point designated as a heel (22—22). The apparatus is made attachable as a result of a clamp (26) which is permanantly affixed to the exterior of the spine (16) and which, because of its gripping ability and its male velcro lining, enables the host apparatus to be attached to the leg of a table permanantly dressed with the corresponding female side of the velcro.

7 Claims, 2 Drawing Sheets

BEVERAGE HOLDER ATTACHABLE TO THE LEG OF A TABLE HAVING Z-SHAPED PARALLEL PLATFORMS

FIELD OF INVENTION

1. Background of the Invention

My invention relates to a holding device for individual portions of snacks and beverages and, specifically to such a device as is attachable to the legs of tables designed for game playing.

2. Description of Prior Art

Refreshment serving, an integral part of many recreational scenarios, has always been customary at table game settings. However, having refreshments at the table during game play can be an uncomfortable situation. At a card game setting, for example, participants too often must deal with refreshments from the surface of the table. Too often this arrangement is frustrating, since all of the surface is required for game play and equipment. The refreshment containers, therefore, are excess baggage. Furthermore, the contents often spill onto the surface, creating an distasteful situation.

Much attention has been given to the need for adjustable refreshment serving devices on planes, trains and in automobiles. The fold-up tray applies readily in these cases. U.S. Pat. No. 2,107,381 to Louis Leppke (Feb. 8, 1938) discloses a serving device for holding liquid containers and food. This device only facilitates lap lunches and the kind of service mentioned above. Although it provides for food and drink to be contained in one unit, it nevertheless requires table space. Often it is just that type of device that ends up on the floor, creating a potentially hazardous and always messy situation. Neither of the devices described, offers a viable remedy for players at a game table. Such a player would benefit only from a device that would free him or her from having to juggle a refreshment container with other objects when requiring the full surface of the table.

Undoubtedly, most players of table games such as indicated above would find it desirous to have a refreshment holding device that would be convenient to his or her reach and not obstruct the playing area.

OBJECTS

It is, therefore, a major object of my invention to provide an individualized refreshment holding device that is attachable to a leg of a game table in order to be within a player's reach and free the playing surface of excessive elements. Other objects and advantages are (a) to provide a suitable refreshment holding device (hereinafter referred to as a refreshment caddy) that will discourage participants from placing food and drink on the floor, thus causing potentially hazardous conditions (b) to provide a refreshment caddy user-friendly to left or right handed persons (c) to provide a caddy that is adjustable to various heights and positions (d) to provide a device that is easily attached and/or removed (e) to provide a caddy that is adaptable in size and facility of construction for any type of game table (f) to provide an attachable refreshment caddy that will securely hold cups and glasses of a variety of sizes and weights as well as plates for food (g) to provide a caddy that may be constructed from any of a variety of rigid materials having the ability to be rendered pliable Other advantages of the invention are that it is simple and inexpensive to manufacture, cosmetically attractive, useful, sanitary and durable.

The aforementioned and numerous other advantages and objects are inherent in my invention. This will become apparent as it becomes better understood in the following detailed description, which when accompanied by a drawing, reveals the preferred embodiment of my invention.

Reference Numerals in Drawing

Figure 1:
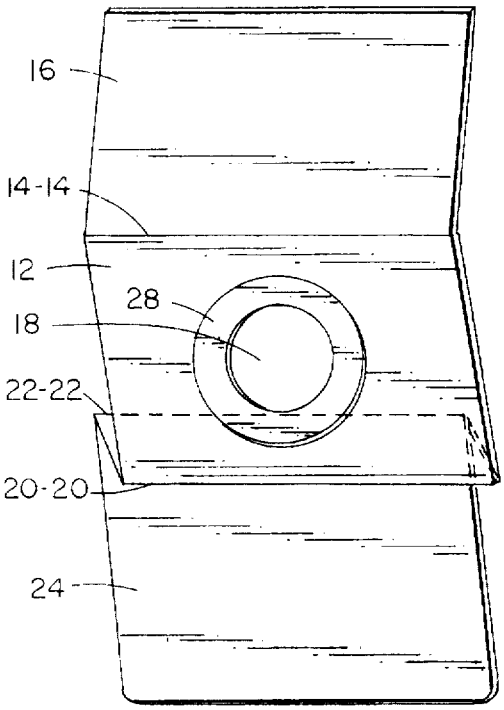
FIG. 1 is a top view of the refreshment caddy

| | | | |
|---|---|---|---|
| 10—10 | longitudinal center | 20—20 | beverage deck border |
| 12 | beverage deck | 22—22 | heel |
| 14—14 | oblique angle vertex | 24 | plate deck |
| 16 | spine | 26 | attachment clamp |
| 18 | hole | 28 | mug guard |

DESCRIPTION OF PREFERRED EMBODIMENTS

Referring now to the drawing, 10—10 denotes a longitudinal center of an attachable refreshment caddy, created from a single rectangular plane. Any rigid material such as aluminum, bamboo, wicker, vinyl or plastic may be used, as long as the material lends itself to cutting and to angular formation, as required for establishing platforms.

Figure 2:
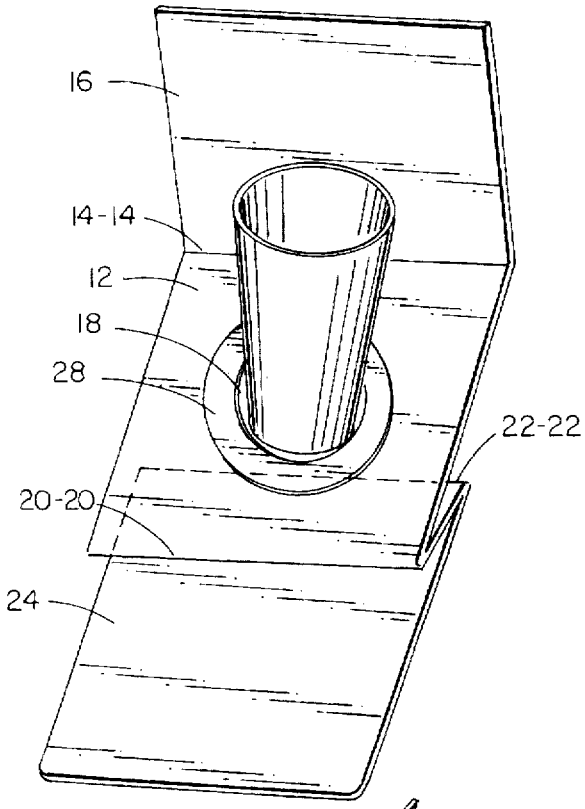
FIG. 2 illustrates the caddy with a cup inserted in the opening on the top platform, (referred to hereinafter as beverage deck)

In this embodiment, a length of opaque acrylic is used. An oblique angle vertex line 14—14, rendered pliable by means of applying a strip heating instrument across that line, allows a spine 16 to be forced upward and forms the oblique angle as seen in FIG. 2. The oblique angle vertex 14—14 is predetermined by having assessed the degree of slant of the leg to which the spine 16 is to be attached. A typical spine 16 will measure 3½ inches, given a rectangle of 14" by 4½", as used in this embodiment. (For a straight leg, the angle forming the spine 16 will be a right angle.) Also, the size of the leg will determine the size of the base material used for the caddy.)

The higher of the two platforms adjacent to the spine may be referred to hereinafter as a beverage deck 12. A hole 18, in this case circular, is cut in the center of the beverage deck 12. The vertically adjacent platforms each have a planar surface. As illustrated in FIG. 2, the hole 18 must be of a size sufficient to secure an average size styrofoam cup at or just below the midpoint of the cup. The hole 18 is now sanded for smoothness.

Figure 4:
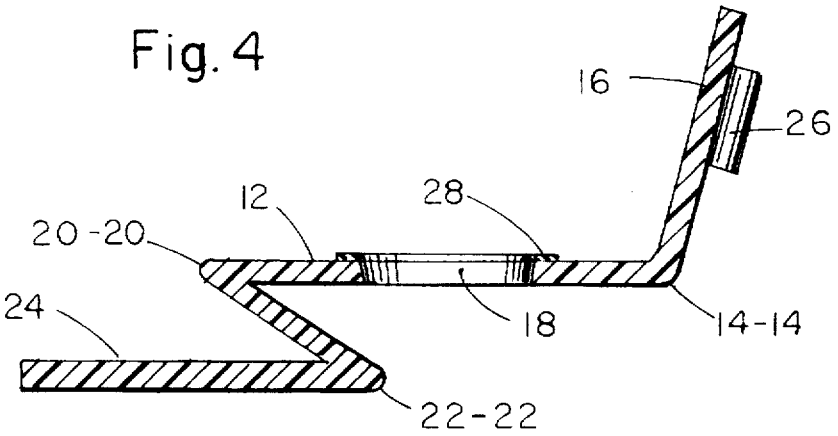
FIG. 4 is a sectional view of line 10—10 in FIG. 3

To construct the invention, two instruments made of wood may be used. One comprises a form of approximately 8" by 6" by 2", flat at one end and shaved to a 45 degree angle at the other. The flat end is permanantly attached perpendicularly to the work surface, where it will serve to create the deck border 20—20. A sectional view of the caddy, as seen in FIG. 4, puts into perspective the relationship between the hole 18 and the deck border 20—20. This view, sharply depicting the angle at the border 20—20, also suggests how the wooden instrument is to be used.

Applying a heating strip across the acrylic material at 20—20 renders it pliable. It is immediately placed upon the form with the beverage deck 12 held perpendicularly against the unshaven side and the border 20—20 aligned with the vertex of the form. The acrylic material beyond the border 20—20 is now forced downward to conform to the shaved side of the form. It must be firmly secured in this position for about 50 seconds or for enough time for the area to cool slightly and lose its pliability.

Having measured and marked the remaining acrylic material 4½" from its end, a line for a heel 22—22 is established and a heating strip applied there. The material is positioned with the beverage deck border 20—20 inverted against the shaved side of the upstanding form and the line marked for a heel 22—22 lined up along the vertex. The remaining material is forced downward, conforming to the flat side of the form. This forms the plate deck 24. For this invention, a plurality of platforms may be integrally arranged to create any number of decks to support multiple containers for serving food and drink. Sufficient time for the material to regain its rigidity must be allowed.

Figure 3:
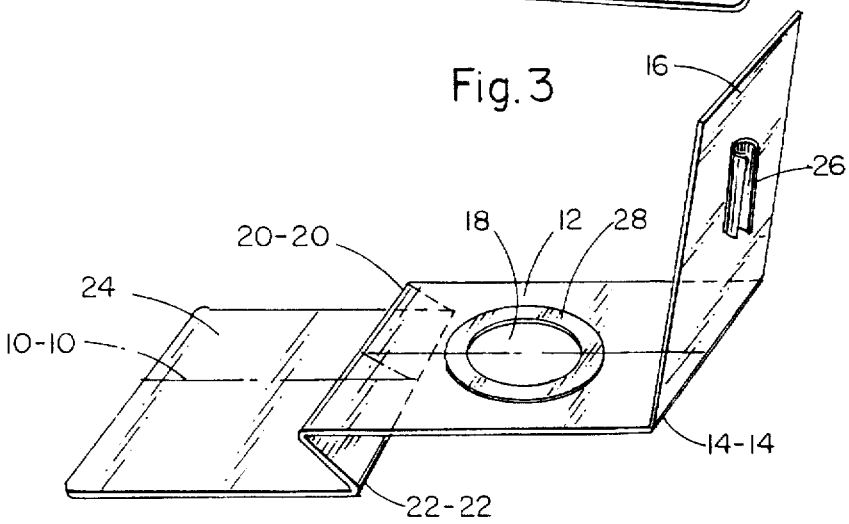
FIG. 3 is an elevated side view

In other words, the adjacent platforms are integrally connected at a fixed reverse angle therebetween. The reverse angle is to be configured such that an acute angle is formed by the edge 20—20 of an adjacent upper platform or beverage deck 12 with the planar surface of the adjacent upper platform. Also, an opposing acute angle is formed by the edge 22—22 of an adjacent lower platform or plate deck 24 with the planar surface of the adjacent lower platform to thereby substantially form a Z-shape as best shown in FIGS. 3 and 4. Therefore, a portion of the planar surface of the adjacent lower platform 24 is positioned underneath the adjacent upper platform 12.

FIG. 3 illustrates the properly formed plate deck 24 which is now recessed under the beverage deck 12. With a sanding instrument, the edges of the spine 16 and the plate deck 24 are now rounded off to a degree that is aesthetically pleasing.

A ring of latex ribbing adhered by means of plexiglas cement is positioned around the hole 18. It forms a procective or mug guard 28, that provides for secure holding of mugs on deck 12.

Figure 5:
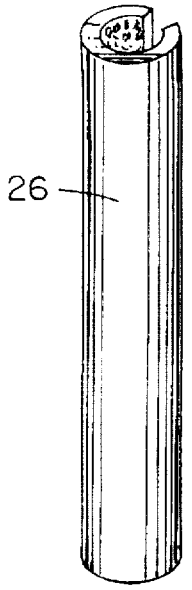
FIG. 5 shows an exploded view of the attachment clamp

An exploded view in FIG. 5 of the attachment clamp 26 reveals it to be a curved U-shaped length which is formed from a single rectangle of acrylic material. (The shape of the clamp 26 may vary depending upon the shape of the table leg for which it is designed.)

A second embodiment may also be illustrated. For this embodiment, the instrument comprises an 8" length of a wooden pole with a circumference like that of the leg to which the clamp 26 will be attached. The pole has been sanded on one side to flatten some of its curviture. The instrument rests flattened side up, between two elevated blocks, with each of its ends inserted into accommodating holes at the top of each block.

Figure 6:
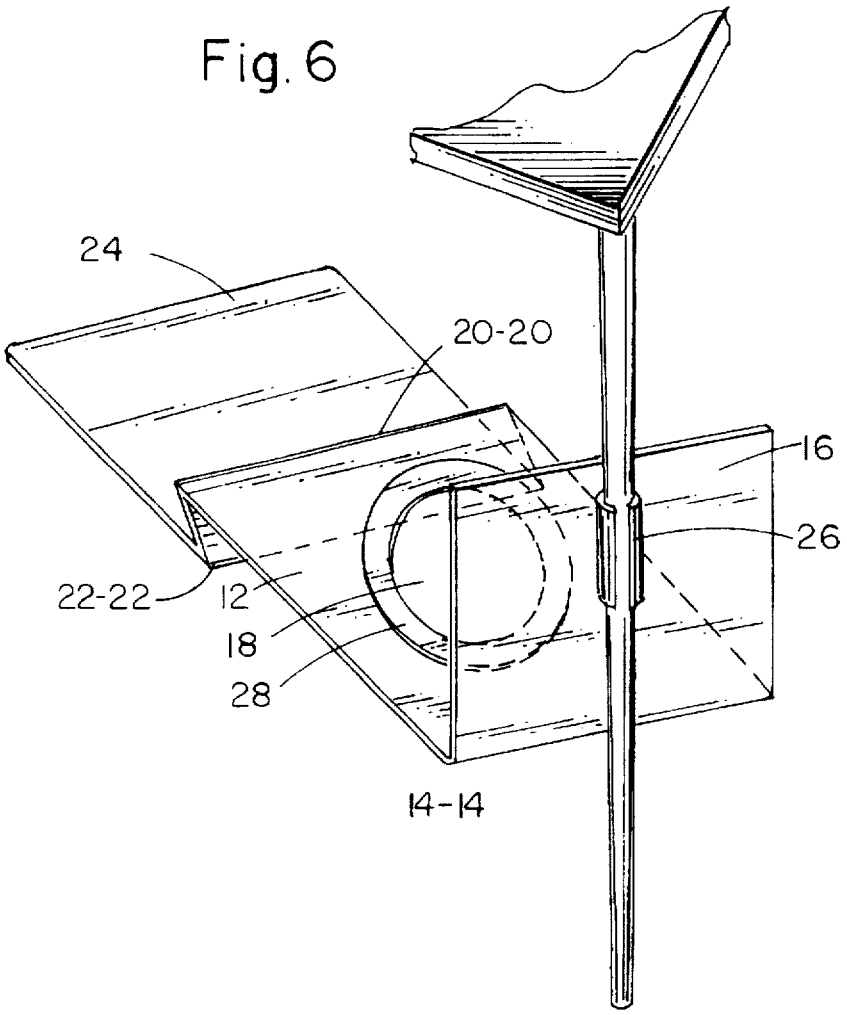
FIG. 6 is a rear view showing the caddy attached to a table leg

By means of heat application, the now pliable acrylic material is draped over this instrument. It conforms to the upper half of the form, with its two sides retaining some distance between them. When the material is rigid against the clamp 26 and sightly tense, is to be removed and lined with plexiglas cement and a hook and loop fastener. (The male or hook side of the hook and loop fastener is suggested for use in the clamp 26 to allow the complementary female or loop side to be adhered to the table leg to which the caddy will be attached. The lined clamp 26 is now adhered by applying heat longitudinally to the center back of the spine 16. Subsequently, small drops of plexiglas cement are applied to the center back of the spine and to the exterior longitudinal center of the clamp 26. Having been lined up and placed together, the two cement laced pieces must be firmly held together until completely fused. The suggested time for fusion is at least 30 minutes. FIG. 6 shows the completed refreshment caddy attached by means of a clamp 26 to a leg of a card table. The male or loop side of the hook and loop fastener lined clamp 26 may be positioned in any direction when engaged with the corresponding female or loop side of the hook and loop fastener permanently surrounding a long section of the leg of a table.

Accordingly, it can readily be seen that the refreshment caddy of my invention can be an extremely useful device. It is well suited for any table where food and drink contained on the surface of the table would constitute a handicap. Referring specifically to the type of table used for card playing, the caddy would be a boon. It is an evolutionary approach to solving problems related to partaking of refreshments.

While a preferred embodiment has been shown and described, various modifications and substitutions may be made without departing from the spirit and scope of this invention. Accordingly, it is understood that this invention has been described by way of illustration rather than limitation.

Having thus described my invention, I claim:

1. A food and beverage container holder for mounting on a game table leg assembly comprising:

a plurality of vertically adjacent platforms, each having a planar surface and at least one of the adjacent platforms having a hole adapted to receive the beverage container, the adjacent platforms integrally connected at a fixed reverse angle therebetween, the reverse angle configured such that one of the plurality of platforms is an upper platform forming an acute angle with an angled spacer and another of said plurality of platforms is a lower adjacent platform that also forms an acute angle with the spacer to thereby substantially form a Z-shape and such that a portion of the planar surface of the adjacent lower platform is positioned underneath the upper platform, and the reverse angle and all but the upper most platform of the plurality of adjacent platforms being otherwise free of other support structure for displacing the food and beverage container holder from the table leg; and clamping means for pliably clamping and receiving the game table leg, said clamping means affixed to the upper most platform of the plurality of the vertically adjacent platforms.

2. The food and beverage container holder as claimed in claim 1, wherein the means for pliable clamping includes a hook and loop fastener.

3. The food and beverage container holder as claimed in claim 1, wherein the means for pliably clamping is a substantially U-shaped clamp.

4. The food and beverage container holder as claimed in claim 1, wherein the hole is lined with a protective guard, the protective guard for securing the beverage container within the hole.

5. A food and beverage container holder for mounting on a game table leg assembly comprising:

a plurality of vertically adjacent platforms, each having a planar surface and integrally connected therebetween, at least one of the adjacent platforms including a hole adapted to receive the beverage container, and at least one of the adjacent platforms having a portion of its planar surface positioned underneath another of the adjacent platforms immediately above in a Z-shaped configuration such that the food and beverage containers may be supported simultaneously on more than one of the platforms and such that the food and beverage containers may be placed at least partially under the adjacent platform immediately above, thereby providing economy of space;

a spine integrally connected to one of the plurality of vertically adjacent platforms, the spine being transverse to the planar surfaces of the vertically adjacent platforms; and a substantially U-shaped and pliable clamping device affixed to the spine for receiving the game table leg assembly.

6. A food and beverage container holder as claimed in claim 5, wherein the pliable clamping device includes a hook and loop fastener.

7. A food and beverage container holder as claimed in claim 5, wherein the hole is lined with a protective guard, the protective guard for securing the beverage container within the hole.

* * * * *